US011840679B2

(12) United States Patent
Delplancke et al.

(10) Patent No.: US 11,840,679 B2
(45) Date of Patent: Dec. 12, 2023

(54) AUTOMATIC DISHWASHING COMPOSITION

(71) Applicant: The Procter & Gamble Company, Cincinnati, OH (US)

(72) Inventors: Patrick Firmin August Delplancke, Steenhuize-Wijnhuize (BE); Joke Govaerts, Opwijk (BE)

(73) Assignee: The Procter & Gamble Company, Cincinnati, OH (US)

( * ) Notice: Subject to any disclaimer, the term of this patent is extended or adjusted under 35 U.S.C. 154(b) by 125 days.

(21) Appl. No.: 17/519,602

(22) Filed: Nov. 5, 2021

(65) Prior Publication Data

US 2022/0186142 A1 Jun. 16, 2022

(30) Foreign Application Priority Data

Nov. 17, 2020 (EP) ..... 20208156

(51) Int. Cl.

| | |
|---|---|
| ***C11D 1/72*** | (2006.01) |
| ***C11D 1/722*** | (2006.01) |
| ***C11D 1/825*** | (2006.01) |
| ***C11D 3/37*** | (2006.01) |
| ***C11D 3/386*** | (2006.01) |
| ***B08B 3/04*** | (2006.01) |
| ***C11D 11/00*** | (2006.01) |
| ***C11D 17/04*** | (2006.01) |

(52) U.S. Cl.

CPC ..... *C11D 1/825* (2013.01); *C11D 1/72* (2013.01); *C11D 1/722* (2013.01); *C11D 3/3707* (2013.01); *C11D 3/386* (2013.01); *C11D 11/0035* (2013.01); *C11D 17/042* (2013.01)

(58) Field of Classification Search

CPC ..... C11D 1/72; C11D 1/721; C11D 1/722; C11D 1/825; C11D 1/8255; C11D 3/3707; C11D 3/386; B08B 3/04

See application file for complete search history.

(56) References Cited

U.S. PATENT DOCUMENTS 9,969,959 B2 5/2018 Roerdink Lander et al.

FOREIGN PATENT DOCUMENTS

| | | | | |
|---|---|---|---|---|
| EP | 2087028 | * | 10/2014 | ..... C08J 5/18 |
| EP | 3425035 A1 | | 1/2019 | |
| EP | 3425035 | * | 9/2019 | ..... C11D 7/60 |
| WO | 9520027 A1 | | 7/1995 | |
| WO | 2006028617 A1 | | 3/2006 | |
| WO | WO 2010/067054 | * | 6/2010 | ..... C11D 17/00 |
| WO | 2019070924 A1 | | 4/2019 | |

OTHER PUBLICATIONS

Anonymous: "Pluronic 25R2—BASF", Apr. 14, 2021 (Apr. 14, 2021), XP055795899,Retrieved from the Internet: URL: https://hcii.basf.us/products/pluronic-25r2/.

Basf: "Plurafac LF types", Mar. 26, 2020 (Mar. 26, 2020), XP055795537, Retrieved from the Internet: URL:http://www.timing-ouhan.com/images/ plurafaciftypes.pdf; 19 pages.

Clarinat: "Genapol EP 2454", Apr. 24, 2013 (Apr. 24, 2013), XP055795674, Retrieved from the Internet: URL:https://www.essentialingredients.com/spec/GenapoP/O20EP%202454.pdf.

Extended EP Search Report and Search Opinion for 20208156.8 dated Apr. 26, 2021, 9 pages.

Extended EP Search Report and Search Opinion for 21206658.3 dated Feb. 7, 2022, 14 pages.

PCT Search Report and Written Opinion for PCT/US2021/058144 dated Feb. 7, 2022, 19 pages.

Guiraud Simon et al: "The Reverse Block Copolymer Pluronic 25R2 Promotes DNA Transfection of Skeletal Muscle : The Reverse Block Copolymer Pluronic 25R2 Promotes . . . ", Macromolecular Bioscience, vol. 11, No. 5, Feb. 17, 2011 (Feb. 17, 2011), pp. 590-594.

Sasol: "Novel 1012GB-21 Ethoxylate", Jun. 2, 2020 (Jun. 2, 2020), XP055795526,Retrieved from the Internet: URL: http://www.sasoltechdata.com/tds/NOVEL%201012GB-21%20Ethoxylate%20TDS.pdf.

Shell: "NEODOL Ethoxylates Typical Properties", Jun. 2, 2006 (Jun. 2, 2006), XP055795802, Retrieved from the Internet: URL:https://www.shell.com/business-customers/chemicals/our-products/ higher-olefins-and-derivatives/neodol-alcohols-and-ethoxylates/ jcr_content/par/tabbedcontent/tab_1780231844/textimage.stream/1519786067052/0aff9909e5721ac1ea098cefff3b46a97904b325/neo06-qrc-ethox-typpropn23n25.pdf.

* cited by examiner

*Primary Examiner* — Brian P Mruk
(74) *Attorney, Agent, or Firm* — Carolyn S. Powell

(57) ABSTRACT

An automatic dishwashing composition having a ternary mixture of non-ionic surfactants comprising: i) a non-ionic surfactant having a high cloud point of 50° C. or above; ii) a non-ionic surfactant having a low cloud point below 50° C.; and iii) an ethylene oxide-propylene oxide block copolymer having a cloud point below 50° C.

10 Claims, No Drawings

AUTOMATIC DISHWASHING COMPOSITION

FIELD OF THE INVENTION

The present invention is in the field of automatic dishwashing. In particular, it relates to a composition comprising a ternary mixture of non-ionic surfactant. The composition of the invention provides improved grease suspension and shine, even at low temperatures, and also provides improved drying.

BACKGROUND OF THE INVENTION

The trend in automatic dishwashing is to reduce the amount energy required for the automatic dishwashing process. A way to reduce energy consumption is to use lower temperatures. Lower temperatures have drawbacks associated to its use, in particular in the case of heavily soiled loads that present a high level of grease. Grease at low temperatures can redeposit onto items in the dishwasher, causing filming and spots, and into the interior parts of the dishwasher, including on the filter. Another drawback is that the items may not be dried at the end of the process.

WO2010/067054A1 discloses a liquid composition comprising a non-ionic surfactant mixture comprising a) a non-ionic surfactant having a cloud point of 50° C. or above, and b) a non-ionic surfactant having a cloud point of below 50° C., wherein the weight ratio of a) to b) is in the range of from 2.25:1 to 1:1. The composition provides good drying but there is an opportunity to further improve the drying time.

It is an objective of the present invention to provide a composition with improved grease suspension and shine, even at low temperatures, and good drying.

SUMMARY OF THE INVENTION

According to the first aspect of the invention, there is provided an automatic dishwashing composition. The composition comprises a ternary mixture of non-ionic surfactants. The ternary mixture comprises:

(a) a non-ionic surfactant having a high cloud point of 50° C. or above, wherein the high cloud point non-ionic surfactant is an alkoxylated $C_{6-22}$ alcohol non-ionic surfactant having a single alkoxylate type and having from 3 to 20 moles of alkylene oxide per mole of surfactant;

(b) a non-ionic surfactant having a low cloud point below 50° C., wherein the low cloud point non-ionic surfactant is an alkoxylated $C_{4-25}$ alcohol non-ionic surfactant having only two alkoxylate types selected from ethoxy, propoxy and butoxy; and (c) an ethylene oxide-propylene oxide block copolymer having a cloud point below 50° C., wherein the ethylene oxide-propylene oxide block copolymer is a triblock copolymer having one of the following structures:

$$EOx1POy1EOx2 \quad (I)$$

$$POy2EOx3POy3 \quad (II)$$

wherein each of x1, x2 and x3 is in the range of from about 1 to about 50 and each of y1, y2 and y3 is in the range of from about 10 to about 70, wherein the weight ratio of the high cloud point non-ionic surfactant (a) to the ethylene oxide-propylene oxide block copolymer (c) is at least about 1.2:1, and wherein the weight ratio of the low cloud point non-ionic surfactant (b) to the ethylene oxide-propylene oxide block copolymer (c) is at least about 1.2:1.

The composition of the invention can be used in the main wash or in the rinse in automatic dishwashing. It can be part of a main wash detergent or a rinse aid or added separately from an auto-dosing dispenser either in the main wash, in the rinse or in both. The composition can be delivered from an auto-dosing dispenser. It can also be dispensed from the dispenser of the dishwashing in unit-dose form or from the rinse aid reservoir in the form of a rinse aid.

According to further aspects of the invention, there are provided methods of automatic dishwashing and uses of the composition of the invention to provide grease suspension and drying.

The elements of the first aspect of the invention apply mutatis mutandis to the other aspects of the invention.

DETAILED DESCRIPTION OF THE INVENTION

The present invention encompasses an automatic dishwashing composition comprising a ternary mixture of non-ionic surfactants. The invention also encompasses methods and uses of the composition to provide good grease suspension and shine, even at low temperatures, and good drying. The methods preferably take place in a domestic dishwasher.

Automatic dishwashing machines may be domestic or commercial/institutional machine types. Generally, the differences are in terms of size, volume of throughput and duration of the dishwashing process. This can mean the machines are designed in very different ways. Industrial/institutional machines often have much shorter but more energy intensive (e.g. higher temperature) cycles compared to domestic machines, and/or use much more aggressive chemistry. Typically, they will not use enzymes, because these need a certain contact time with the treated soils to perform effectively, and the commercial cycle time is too short. In the case of commercial dishwashers, the machines can be based on a conveyor system in which dishware is moved through a single or multiple tanks of the dishwasher, whereas in domestic machines the dishware will generally always remain stationary in one tank inside the dishwasher, and all the washing steps will occur in that single tank. In domestic dishwashing, it is conventional to include bleaches and enzymes in the detergent.

The term "automatic dishwashing detergent composition" as used herein means a dishwashing composition to be used in dishwashing machine.

"Dishware" herein means cookware, dishware and tableware, i.e. all items related to cooking and serving food and drinks that are usually washed in a dishwasher.

As used herein, the articles including "a" and "an" are understood to mean one or more of what is claimed or described. Unless otherwise noted, all component or composition levels are in reference to the active portion of that component or composition, and are exclusive of impurities, for example, residual solvents or by-products, which may be present in commercially available sources of such components or compositions. Unless specifically stated or the context otherwise requires, embodiments described herein apply equally to all aspects of the invention. Percentages quoted are by weight, unless otherwise stated or the context otherwise requires.

All measurements are performed at 25° C. unless otherwise specified.

The Ternary Surfactant Mixture

The composition comprises a ternary mixture of non-ionic surfactants. The ternary mixture comprises:

(a) a non-ionic surfactant having a high cloud point of 50° C. or above, wherein the high cloud point non-ionic surfactant is an alkoxylated $C_{6-22}$ alcohol non-ionic surfactant having a single alkoxylate type and having from 3 to 20 moles of alkylene oxide per mole of surfactant;

(b) a non-ionic surfactant having a low cloud point below 50° C., wherein the low cloud point non-ionic surfactant is an alkoxylated $C_{4-25}$ alcohol non-ionic surfactant having only two alkoxylate types selected from ethoxy, propoxy and butoxy; and (c) an ethylene oxide-propylene oxide block copolymer having a cloud point below 50° C., below 40° C., wherein the ethylene oxide-propylene oxide block copolymer is a triblock copolymer having one of the following structures:

$$EOx1POy1EOx2 \quad (I)$$

$$POy2EOx3POy3 \quad (II)$$

wherein each of x1, x2 and x3 is in the range of from about 1 to about 50 and each of y1, y2 and y3 is in the range of from about 10 to about 70, wherein the weight ratio of the high cloud point non-ionic surfactant (a) to the ethylene oxide-propylene oxide block copolymer (c) is at least about 1.2:1, and wherein the weight ratio of the low cloud point non-ionic surfactant (b) to the ethylene oxide-propylene oxide block copolymer (c) is at least about 1.2:1.

The weight ratio of the high cloud point non-ionic surfactant (a) to the ethylene oxide-propylene oxide block copolymer (c) may be at least about 1.3:1, or at least about 1.4:1, or at least about 1.5:1, or at least about 1.6:1, or at least about 1.7:1, or at least about 1.8:1, or at least about 1.9:1, or at least about 2.0:1, or at least about 2.1:1, or at least about 2.2:1, or at least about 2.3:1, or at least about 2.4:1, or at least about 2.5:1, or at least about 2.6:1, or at least about 2.7:1, or at least about 2.8:1, or at least about 2.9:1, or at least about 3.0:1. The weight ratio of the high cloud point non-ionic surfactant (a) to the ethylene oxide-propylene oxide block copolymer (c) may be from at least about 1.2:1 to 20:1, or from at least about 1.5:1 to 15:1, or from at least about 2.0:1 to 10:1.

The weight ratio of the low cloud point non-ionic surfactant (b) to the ethylene oxide-propylene oxide block copolymer (c) may be at least about 1.3:1, or at least about 1.4:1, or at least about 1.5:1, or at least about 1.6:1, or at least about 1.7:1, or at least about 1.8:1, or at least about 1.9:1, or at least about 2.0:1, or at least about 2.1:1, or at least about 2.2:1, or at least about 2.3:1, or at least about 2.4:1, or at least about 2.5:1, or at least about 2.6:1, or at least about 2.7:1, or at least about 2.8:1, or at least about 2.9:1, or at least about 3.0:1. The weight ratio of the low cloud point non-ionic surfactant (b) to the ethylene oxide-propylene oxide block copolymer (c) may be from at least about 1.2:1 to 20:1, or from at least about 1.5:1 to 15:1, or from at least about 2.0:1 to 10:1.

The ternary mixture of non-ionic surfactant included in the compositions according to the present invention is described hereinbelow. Compositions comprising this mixture have been found to exhibit good grease suspension, even at low temperatures, and drying properties especially on items treated in a dishwashing operation.

The composition of the invention comprises a ternary surfactant mixture comprising; a) a non-ionic surfactant having a cloud point of 50° C. or above (herein referred to as "high cloud point non-ionic surfactant"), and b) a non-ionic surfactant having a cloud point below 50° C. (herein referred to as "low cloud point non-ionic surfactant"), wherein the weight ratio of a) to b) is in the range of from 2:1 to 1:2. The ternary surfactant mixture further comprises an ethylene oxide-propylene oxide triblock copolymer having a cloud point below 50° C., or below 40° C.

The cloud point is the temperature at which a non-ionic surfactant solution phase separates into a water rich and surfactant rich phase and becomes cloudy. The cloud point temperature can be determined visually by identifying at which temperature cloudiness occurs.

The cloud point temperature of a non-ionic surfactant can be determined as follows: a solution containing 1% of the corresponding non-ionic surfactant by weight of the solution is prepared in distilled water. The solution is stirred gently before analysis to ensure that the process occurs in chemical equilibrium. The cloud point temperature is taken in a thermostatic bath by immersing the surfactant solution in a 75 mm sealed glass test tube. To ensure the absence of leakage, the test tube is weighed before and after the cloud point temperature measurement. The temperature is gradually increased at a rate of less than 1° C. per minute, until the temperature reaches a few degrees below the pre-estimated cloud point. The cloud point temperature is determined visually at the first sign of turbidity.

It is preferred that the cloud point of the high cloud point non-ionic surfactant is in the range of from 55° C. to 85° C. or 60° C. to 80° C. The cloud point of the low cloud point non-ionic surfactant can be in the range of from 5° C. to 45° C., or 8° C. to 35° C.

According to the present invention the high cloud point nonionic surfactant can have a cloud point in the range of from 60° C. to 80° C. and the low cloud point nonionic surfactant has a cloud point in the range of from 8° C. to 35° C. Particularly good results have been achieved according to the invention by compositions comprising a non-ionic surfactant mixture, wherein the high cloud point non-ionic surfactant is an alkoxylkated non-ionic surfactant having a single alkoxylate type, and the low cloud point non-ionic surfactant is an alkoxylkated non-ionic surfactant having at least two alkoxylate types.

The alkoxylated non-ionic surfactants of high cloud point may be prepared by the reaction of a monohydroxy alkanol or alkylphenol with 6 to 22 carbon atoms, 8 to 20 carbon atoms, or 10 to 18 carbon atoms. The type of alkoxylate surfactant can be ethoxylate, butoxylate or propoxylate with ethoxylate being especially preferred. The high cloud point surfactants can have 3 to 20 moles, 4 to 10 moles, or 5 to 8 moles of alkylene oxide, particularly ethylene oxide, per mole of alcohol or alkylphenol. A particularly preferred high cloud point non-ionic surfactant is C10-C15 with 5-10 EO, or C13 with 7EO. The high cloud point non-ionic surfactants may be prepared from either branched or linear chain fatty alcohols of the above types.

Preferred examples of high cloud point non-ionic surfactants are Lutensol TO7 (BASF), Marlipal O13/70 (Sasol), Imbentin-T/070 (Kolb), Emuldac AS-11 (Sasol) and Emuldac AS-20 (Sasol).

The alkoxylated non-ionic surfactants of low cloud point may be prepared by the reaction of a monohydroxy alkanol or alkylphenol with 4 to 25 carbon atoms, 6 to 20 carbon atoms, or 8 to 14 carbon atoms. The low cloud point surfactant has 2 to 45 moles in total of alkylene oxide per mole of surfactant. The type of alkoxylates in low cloud point surfactant is a mixture of at least two of ethoxylate, butoxylate and/or propoxylate, with a mixture of ethoxylate and propoxylate being especially preferred. The low cloud point surfactants have 2 to 25 moles, especially 5 to 20 moles of ethylene oxide per mole of alcohol or alkylphenol and 2 to 40 moles, or 5 to 30 moles of propylene oxide per mole of alcohol or alkylphenol. A mixture of butylene oxide or propylene oxide is also possible. A low cloud point surfactant is C10-C12 with 10-20 EO and 10-20 PO. The low cloud point non-ionic surfactants may be prepared from either branched or linear chain fatty alcohols of the above types.

Low cloud point surfactants may also include surfactants which are ethoxylated and butoxylated mono-hydroxy alkanols or alkylphenols, which additionally comprises polyoxyethylene-polyoxypropylene block copolymer units. The alcohol or alkylphenol portion of such surfactants constitutes more than 30%, more than 50%, or more than 70% by weight of the overall molecular weight of the non-ionic surfactant.

Preferred examples of low cloud point non-ionic surfactants are Plurafac SLF-180 (BASF) and Ecosurf LFE-1410 (Dow). Another preferred low cloud point non-ionic surfactant is LF224. A combination of low cloud point non-ionic surfactants can also be used, for example a combination of SLF180 and LF224.

The low cloud point surfactant is typically more hydrophobic than the high cloud point surfactant and the amounts and types of the two surfactants in the claimed mixture are selected such that the foaming characteristics of the composition are controlled to within the desired range. For automatic dishwashing applications it is usual to desire low-foaming characteristics.

It is especially preferred according to the present invention that the high cloud point non-ionic surfactant is an ethoxylated non-ionic surfactant and the low cloud point non-ionic surfactant is a mixed propoxylated-ethoxylated-propoxylated non-ionic surfactant.

The weight ratio of high cloud point to low cloud point non-ionic surfactant can be in the range 2:1 to 1:2, or 1.5:1 to 1:1.5.

In the case of a composition for use in the main wash of an automatic dishwashing program, the amount of non-ionic ternary surfactant mixture is from 0.5 to 20% by weight of the composition. In the case of a composition for use in the rinse of an automatic dishwashing program, the amount of non-ionic ternary mixture is from 0.5 to 40% by weight of the composition.

Ethylene Oxide-Propylene Oxide Block Copolymer

The ethylene oxide-propylene oxide block copolymer is a triblock copolymer and can have one of the following structures:

$$EOx1POy1EOx2 \quad (I)$$

$$POy2EOx3POy3 \quad (II)$$

wherein each of x1, x2 and x3 is in the range of from about 1 to about 50 and each of y1, y2 and y3 is in the range of from about 10 to about 70.

The ethylene oxide-propylene oxide-ethylene oxide triblock copolymer of Formula I can have an average propylene oxide chain length of between 10 and 70, between 20 and 60, or between 25 and 55 propylene oxide units.

The ethylene oxide-propylene oxide-ethylene oxide triblock copolymer of Formula II can have an average ethylene oxide chain length of between 1 and 50, between 2 and 40, between 3 and 30 ethylene oxide units.

The ethylene oxide-propylene oxide triblock copolymer of Formula I and Formula II have a cloud point lower than 50° C., lower than 40° C.

The ethylene oxide-propylene oxide triblock copolymers of Formula I and Formula II can have a weight average molecular weight of between about 1000 and about 10,000 Daltons, between about 1200 and about 8000 Daltons, between about 1500 and about 7000 Daltons, between about 1750 and about 5000 Daltons, or between about 2000 and about 4000 Daltons.

Suitable ethylene oxide-propylene oxide triblock copolymers are commercially available under the Pluronic PE and Pluronic RPE series from the BASF company, or under the Tergitol L series from the Dow Chemical Company. Particularly suitable materials are Pluronic PE 9200, Tergitol L81, Tergitol L62, Tergitol L61, Pluronic RPE 3110 and Pluronic RPE 2520.

The composition of the invention may be a phosphate-free cleaning composition. The composition may be free of anionic and cationic surfactants. The composition comprises the surfactant ternary mixture and optionally a complexing agent, a dispersant polymer, bleach, inorganic builder (e.g. carbonate and/or silicate), enzymes, in particular protease and amylase enzymes, glass care agents, metal care agents, etc.

When the composition of the invention is a cleaning composition, it can have a pH as measured in 1% weight aqueous solution in distilled water at 20° C. of at least 10, or at least 10.5.

Complexing Agents

Complexing agents are materials capable of sequestering hardness ions, particularly calcium and/or magnesium.

The composition of the invention may comprise from 10% to 60%, from 20% to 40%, or from 20% to 35% by weight of the composition of a complexing agent selected from the group consisting of methylglycine-N,N-diacetic acid (MGDA), glutamic acid-N,N-diacetic acid (GLDA), iminodisuccinic acid (IDS), citric acid, aspartic acid —N,N-diacetic acid (ASDA) its salts and mixtures thereof. Especially preferred complexing agent for use herein is a salt of MGDA, in particular the trisodium salt of MGDA. Mixture of citrate and the trisodium salt of MGDA are also preferred for use herein. Preferably, the composition of the invention comprises from 15% to 40% by weight of the composition of the trisodium salt of MGDA.

Inorganic Builder

The composition of the invention comprises an inorganic builder. Suitable inorganic builders are selected from the group consisting of carbonate, silicate and mixtures thereof. Especially preferred for use herein are sodium carbonate and silicate. The composition of the invention may comprise from 5 to 50%, from 10 to 40% or from 15 to 30% of sodium carbonate by weight of the composition.

Polymer

The polymer, if present, is used in any suitable amount from about 0.1% to about 30%, from 0.5% to about 20%, or from 1% to 15% by weight of the composition. Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, or from about 5,000 Da to about 45,000 Da.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfo-propylmethacrylate, sulfomethacrylamide, sulfomethylmethacrylamide and mixtures of said acids or their water-soluble salts.

The polymer comprises the following levels of monomers: from about 40 to about 90%, or from about 60 to about 90% by weight of the polymer of one or more carboxylic acid monomer; from about 5 to about 50%, or from about 10 to about 40% by weight of the polymer of one or more sulfonic acid monomer; and optionally from about 1% to about 30%, or from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is (meth)acrylic acid. The sulfonic acid monomer can be 2-acrylamido-2-propanesulfonic acid (AMPS).

Preferred commercial available polymers include: Alcosperse 240 and Aquatreat AR 540 supplied by Nouryon; Acumer 3100, Acumer 2000, Acusol 587G and Acusol 588G supplied by Dow. Particularly preferred polymers are Acusol 587G and Acusol 588G supplied by Dow. Suitable polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, or from about 5,000 to about 45,000 g/mol. The dispersant polymer may be a low molecular weight homopolymer of polyacrylate, with an average molecular weight of from 1,000 to 20,000, particularly from 2,000 to 10,000, and particularly from 3,000 to 5,000.

The polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000, from 20,000 to 50,000, and 30,000 to 40,000 g/mol. and a ratio of (meth)acrylate to maleate or fumarate segments of from 30:1 to 1:2.

The polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such polymer may have a molecular weight of from 4,000 to 20,000 and an acrylamide content of from 0% to 15%, by weight of the polymer.

Polymers suitable herein also include itaconic acid homopolymers and copolymers. Alternatively, the polymer can be selected from the group consisting of alkoxylated polyalkyleneimines, alkoxylated polycarboxylates, polyethylene glycols, styrene co-polymers, cellulose sulfate esters, carboxylated polysaccharides, amphiphilic graft copolymers and mixtures thereof.

Enzymes

The composition of the invention comprises enzyme, e.g. amylases and proteases. In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases are polypeptides demonstrating at least 90%, at least 95%, at least 98%, at least 99%, or 100% identity with the wild-type enzyme from *Bacillus lentus*, comprising mutations in one or more, two or more, or three or more of the following positions, using the BPN' numbering system and amino acid abbreviations as illustrated in WO00/37627, which is incorporated herein by reference:V68A, N87S, S99D, S99SD, S99A, S101G, S101M, S103A, V104N/I, G118V, G118R, S128L, P129Q, S130A, Y167A, R170S, A194P, V205I and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

G118V+S128L+P129Q+S130A (i)

S101M+G118V+S128L+P129Q+S130A (ii)

N76D+N87R+G118R+S128L+P129Q+S130A+S188D+N248R (iii)

N76D+N87R+G118R+S128L+P129Q+S130A+S188D+V244R (iv)

N76D+N87R+G118R+S128L+P129Q+S130A (v)

V68A+N87S+S101G+V104N (vi)

Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the second composition include from about 0.2 to about 2 mg of active protease per grams of the composition.

Amylases

The composition of the invention may comprise amylases. A preferred alkaline amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 SEQ ID No. 3:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (SEQ ID NO:7 in U.S. Pat. No. 6,093,562), especially those comprising one or more of the following mutations M202, M208, S255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, EVEREST®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE®, EXCELLENZ™ S series, including EXCELLENZ™ S 1000 and EXCELLENZ™ S 2000 and PURASTAR OXAM® (DuPont Industrial Biosciences, Palo Alto, California) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, EXCELLENZ™ S 1000, EXCELLENZ™ S2000 and mixtures thereof.

The composition of the invention comprises at least 0.005 mg, from about 0.0025 to about 0.025, from about 0.05 to about 0.3, or from about 0.01 to about 0.25 mg of active amylase.

The protease and/or amylase of the composition may be in the form of granulates, where the granulates comprise more than 29% of sodium sulfate by weight of the granulate and/or the sodium sulfate and the active enzyme (protease and/or amylase) are in a weight ratio of between 3:1 and 100:1, between 4:1 and 30:1 or between 5:1 and 20:1.

Crystal Growth Inhibitor

Crystal growth inhibitors are materials that can bind to calcium carbonate crystals and prevent further growth of species such as aragonite and calcite. Especially preferred crystal growth inhibitor for use herein is HEDP (1-hydroxyethylidene 1,1-diphosphonic acid). The composition of the invention may comprise from 0.01 to 5%, from 0.05 to 3% or from 0.5 to 2% of a crystal growth inhibitor by weight of the composition, preferably HEDP.

Bleach

The composition of the invention may comprise from about 8 to about 30%, from about 9 to about 25%, or from about 9 to about 20% of bleach by weight of the composition.

Inorganic and organic bleaches are suitable for use herein. Inorganic bleaches include perhydrate salts such as perborate, percarbonate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially dodecanediperoxoic acid, tetradecanediperoxoic acid, and hexadecanediperoxoic acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having from 1 to 12 carbon atoms, from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5 or from 0.2 to 2% by weight of the composition of bleach activator, preferably TAED.

Bleach Catalyst

The composition of the invention may contain a bleach catalyst, preferably a metal containing bleach catalyst. The metal containing bleach catalyst can be a transition metal containing bleach catalyst, especially a manganese or cobalt-containing bleach catalyst. Bleach catalysts preferred for use herein include manganese triazacyclononane and related complexes; Co, Cu, Mn and Fe bispyridylamine and related complexes; and pentamine acetate cobalt(III) and related complexes.

The composition may comprise from 0.001 to 0.5 or from 0.002 to 0.05% of bleach catalyst by weight of the composition. Preferably the bleach catalyst is a manganese bleach catalyst.

Metal Care Agents

Metal care agents may prevent or reduce the tarnishing, corrosion or oxidation of metals, including aluminium, stainless steel and non-ferrous metals, such as silver and copper. The composition of the invention may comprise from 0.1 to 5%, from 0.2 to 4% or from 0.3 to 3% by weight of the composition of a metal care agent, preferably the metal care agent is benzo triazole (BTA).

Glass Care Agents

Glass care agents protect the appearance of glass items during the dishwashing process. The composition of the invention may comprise from 0.1 to 5%, from 0.2 to 4% or from 0.3 to 3% by weight of the composition of a glass care agent. The glass care agent can be a zinc salt.

The composition of the invention may be a rinse aid comprising the non-ionic ternary mixture and optionally hydrotropes, perfumes, complexing agents, glass care agents, metal care agents, etc. Such ingredients may be present in amounts of up to 5% by weight of the invention. When the composition of the invention is a rinse aid, it can have a pH as measured in 1% weight/volume aqueous solution in distilled water at 20° C. of from less than 8, or less than 7.5. The cleaning composition of the invention may comprise:

i) from 5 to 50% by weight of the composition of a builder;
ii) from 0.5 to 10% by weight of the composition of non-ionic ternary mixture;
iii) from 5 to 50% by weight of the composition of a complexing agent, wherein the complexing agent comprises a salt of MGDA;
iv) enzymes, wherein the enzymes comprise an amylase and a protease;
v) optionally from 0.5 to 5% by weight of the composition of a dispersant polymer, wherein the dispersant polymer comprises a carboxylate/sulfonate polymer;
vi) optionally from 5 to 20% by weight of the composition of bleach and/or a bleach catalyst;

The composition of the invention can be a rinse aid comprising the ternary mixture of non-ionic surfactant and other customary rinse aid ingredients.

Hydrotropes

The rinse aid composition of the present invention can include a hydrotrope. A hydrotrope creates increased water solubility of hydrophobic materials and ensures physical stability of the composition. In some embodiments, hydrotropes are low molecular weight aromatic sulfonate materials such as cumene sulfonate, xylene sulfonate and dialkyldiphenyl oxide sulfonate materials. In other embodiments, hydrotropes are short chainlength alkyl sulfates with less than 10 carbon atoms in the alkyl chain.

A hydrotrope or combination of hydrotropes can be present in the compositions at an amount of from between about 1% to about 50% by weight of the composition. In other embodiments, a hydrotrope or combination of hydrotropes can be present at about 10% to about 30% by weight of the composition.

Carriers

The rinse composition of the present invention can be formulated as liquid compositions. Carriers can be included in such liquid formulations. Any carrier suitable for use in a rinse aid composition can be used in the present invention. For example, in some embodiments the compositions include water as a carrier.

In some embodiments, liquid rinse aid compositions according to the present invention will contain no more than about 98% by weight of the composition of water and typically no more than about 90% by weight of the composition of water. In other embodiments, liquid rinse aid compositions will contain at least 50% by weight of the composition of water, or at least 60% by weight of the composition of water as a carrier.

The rinse composition may comprise a pH regulator agent, glass care and/or metal care agents.

Methods of the Invention

A method of the invention comprises the following steps to be performed in a dishwasher:

a) placing the dishware in the dishwasher; and
b) subjecting the dishware to a main wash liquor comprising the non-ionic ternary mixture of the invention.

This method provides removal of greasy soils, even in the case of very stressed loads, i.e. loads comprising a high level of soils, including greasy soils, and in programs having low temperature wash cycles.

By "low temperature" is herein meant a program having a main wash temperature of 55° or below, 45° C. or below, or 40° C. or below.

Another method of the invention comprises the following steps to be performed in a dishwasher:

a) placing the dishware in the dishwasher; and
b) subjecting the dishware to a rinse wash liquor comprising the non-ionic ternary mixture of the invention.

This method provides good drying, even in very stresses systems and in programs having low temperature cycles.

There is also provided a method of providing drying through the wash in a dishwasher comprising the step of delivering into the main wash of the dishwasher an automatic dishwashing detergent composition comprising the ternary mixture of non-ionic surfactants. The method provided good drying even when the composition is delivered in unit dose form.

In the context of the present application, "a dishwashing program" is a completed cleaning process that may include a pre-wash, pre-rinse and/or a rinse cycle in addition to the main wash cycle, and which can be selected and actuated by means of the program switch of the dishwasher. The duration of these separate cleaning programs is advantageously at least 15 minutes, advantageously from 20 to 360 minutes, or from 20 to 90 minutes. Within the meaning of this application, "short cleaning programs" last less than 60 minutes and "long cleaning programs" last less than 60 minutes.

A domestic dishwasher can usually provide a plurality of programs, such as a basic wash program, for washing normally dirty dishware dried up to a certain extent; an intensive wash program, for washing very dirty dishware, or in case of food rests particularly difficult to remove (very dry or burnt spots); an economy wash program, for washing lightly dirty dishware or partial loads of dishware; fast wash program, for a washing like the previous cycle, should a faster washing of partial dishware loadings be wished. Each program comprises a plurality of sequential steps. Usually, one or two cold prewash cycles, a cleaning cycle (also known as main wash), a cold rinse cycle, a hot rinse cycle and optionally a drying cycle. During the different cycles of a program, different compositions can be added to the water in the dishwasher to help the cleaning. The first composition may be delivered into the pre-wash and the second composition into the main-wash cycle.

During the course of a selected dishwashing program a domestic dishwasher generally performs one or more cycles, such as a pre-wash, main-wash, intermediate rinse cycle, final rinse cycle and then a drying cycle to terminate the program. During the respective cycles, wash liquor is distributed, in particular sprayed, by means of a rotating spray arm, a fixed spray nozzle, for example a top spray head, a movable spray nozzle, for example a top spinning unit, and/or some other liquid distribution apparatus, in the treatment chamber of the dishwasher cavity, in which wash liquor is applied to items to be washed, such as dishes and/or cutlery, to be cleaned, which are supported in and/or on at least one loading unit, for example a pull-out rack or a cutlery drawer that can preferably be removed or pulled out. To this end the dishwasher is preferably supplied with wash liquor by way of at least one supply line by an operating circulating pump, said wash liquor collecting at the bottom of the dishwasher cavity, preferably in a depression, in particular in a sump. If the wash liquor must be heated during the respective liquid-conducting washing sub-cycle, the wash liquor is heated by means of a heating facility. This can be part of the circulating pump. At the end of the respective liquid-conducting washing sub-cycle some or all of the wash liquor present in the treatment chamber of the dishwasher cavity in each instance is pumped out by means of a drain pump.

The composition of the invention can be placed in a storage reservoir in the interior of the dishwasher, the reservoir may house a plurality of doses to be dispensed into a plurality of programs.

The reservoir containing the composition of the invention can be located inside or outside of the dishwasher. If placed inside of the dishwasher, the storage reservoir can be integrated into the automatic dishwasher (i.e., a storage reservoir permanently fixed (built in) to the automatic dishwasher), and can also be an autarkic (i.e., an independent storage reservoir that can be inserted into the interior of the automatic dishwasher).

An example of an integrated storage reservoir is a receptacle built into the door of the automatic dishwasher and connected to the interior of the dishwasher by a supply line.

A dosing device can be for example an automated unit comprising the storage reservoir and a dispensing unit capable of releasing a controlled amount of different compositions at different times, for example to the pre-wash and to the main-wash. Different types of hardware might be part of the dosing device for controlling the dispensing of the cleaning composition, or for communicating with external devices such as data processing units, the dishwasher or a mobile device or server that a user can operate.

The storage reservoir should have very good thermal stability, especially if it is to be located in the interior of the dishwasher.

Preferred processes according to the invention are those wherein the compositions, prior to being metered into the interior of the dishwasher, remains in the storage reservoir that is located outside (as for example WO2019/81910A1) or inside of the dishwasher for at least two, at least four, at least eight or at least twelve separate dishwashing programs.

The dosing system can be linked to sensors that can determine, based on sensor's input, the amount of composition required. Sensors that may be used include pH, turbidity, temperature, humidity, conductivity, etc. The dishwasher may require data processing power to achieve this. It is preferred that the dishwashing will have connectivity to other devices. This may take the form of wi-fi, mobile data, blue tooth, etc. This may allow the dishwasher to be monitored and/or controlled remotely. Preferably, this also allows the machine to connect with the internet.

The volume of preferred storage reservoirs containing one or more chambers is from 10 to 1000 ml, from 20 to 800 ml, or from 50 to 500 ml.

The following are embodiments of the present invention:

1. An automatic dishwashing composition comprising a ternary mixture of non-ionic surfactants comprising:
   (a) a non-ionic surfactant having a high cloud point of 50° C. or above, wherein the high cloud point non-ionic surfactant is an alkoxylated $C_{6-22}$ alcohol non-ionic surfactant having a single alkoxylate type and having from 3 to 20 moles of alkylene oxide per mole of surfactant;
   (b) a non-ionic surfactant having a low cloud point below 50° C., wherein the low cloud point non-ionic surfactant is an alkoxylated $C_{4-25}$ alcohol non-ionic surfactant having only two alkoxylate types selected from ethoxy, propoxy and butoxy; and
   (c) an ethylene oxide-propylene oxide block copolymer having a cloud point below 50° C., or below 40° C., wherein the ethylene oxide-propylene oxide block copolymer is a triblock copolymer having one of the following structures:

$$EOx1POy1EOx2 \quad (I)$$

$$POy2EOx3POy3 \quad (II)$$

wherein each of x1, x2 and x3 is in the range of from about 1 to about 50 and each of y1, y2 and y3 is in the range of from about 10 to about 70,
   wherein the weight ratio of the high cloud point non-ionic surfactant (a) to the ethylene oxide-propylene oxide block copolymer (c) is at least about 1.2:1, and wherein the weight ratio of the low cloud point non-ionic surfactant (b) to the ethylene oxide-propylene oxide block copolymer (c) is at least about 1.2:1.

2. A composition according to embodiment 1 wherein the weight average ratio of the high cloud point to the low cloud point non-ionic surfactant is from about 2:1 to 1:2.
3. A composition according to any one of the preceding embodiments, wherein the cloud point of the high cloud point non-ionic surfactant is in the range of from 60° C. to 80° C. and wherein the cloud point of the low cloud point non-ionic surfactant is in the range of from 8° C. to 35° C.
4. A composition according to any one of the preceding embodiments, wherein the high cloud point non-ionic surfactant is an ethoxylated $C_{6-22}$ alcohol non-ionic surfactant.
5. A composition according to any one of the preceding embodiments, wherein the composition comprises from 0.5 to 40% by weight of the composition of the ternary mixture of non-ionic surfactants.
6. A composition according to any one of the preceding embodiments, wherein the composition is phosphate free and comprises enzymes and optionally bleach.
7. A composition according to any one of the preceding embodiments, wherein the composition is a rinse aid.
8. A method to improve grease suspension in automatic dishwashing at low temperature using a composition according to any of embodiments of 1 to 7.
9. Use of a composition according to any of embodiments 1 to 7 to provide improved grease suspension at low temperature in automatic dishwashing.
10. A method of providing drying through the wash in a dishwasher comprising the step of delivering into the main wash of the dishwasher an automatic dishwashing detergent composition according to any of embodiments 1 to 7.
11. A method according to embodiment 10, wherein the detergent composition is in unit dose form.
12. A method of providing drying in a dishwasher comprising the step of delivering into the rinse of the dishwasher a rinse composition according to any of embodiments 1 to 7.
13. Use of a composition according to any of embodiments of 1 to 7 to provide drying through the wash in automatic dishwashing.

EXAMPLES

Automatic dishwashing compositions were made as detailed herein below.

I. Preparation of Test Compositions

Tests were carried out using the following detergent compositions:

| Ingredient | Automatic Dishwashing Powder Composition 1 Level (grams active per dose in 5 L water) |
|---|---|
| Sodium percarbonate | 2.7 |
| MnTACN (1,4,7-trimethyl-1,4,7-triazacyclononane) | 0.008 |
| Sodium carbonate | 2.85 |
| MGDA (Tri-sodium salt of methyl glycine diacetic acid) | 5.49 |

-continued

| Ingredient | Automatic Dishwashing Powder Composition 1 Level (grams active per dose in 5 L water) |
|---|---|
| HEDP (Sodium 1-hydroxyethyidene-1,1-diphosphonate) | 0.12 |
| Acusol ™ 588GF (sulfonated polymer supplied by Dow Chemical) | 0.38 |
| TOTAL g active | 11.55 g |

| Ingredient | Automatic Dishwashing Liquid Composition 1 Level (grams active per dose in 5 L water) | Automatic Dishwashing Liquid Composition 2 Level (grams active per dose in 5 L water) |
|---|---|---|
| Plurafac ® SLF180 (non-ionic surfactant supplied by BASF) | 0.87 | 0.75 |
| Lutensol ® TO7 (non-ionic surfactant supplied by BASF) | 0.87 | 0.75 |
| Pluronic ® PE 9200 (non-ionic surfactant supplied by BASF) | | 0.24 |
| Dipropylene glycol | 0.4 | 0.4 |
| Glycerine | 0.02 | 0.02 |
| TOTAL g active | 2.16 | 2.16 |

II. Test Procedure

The test procedure simulates the wash and rinse cycles of an automatic dishwasher process in small scale and determines grease suspending capacity of the automatic dishwasher compositions. The grease suspending capacity is determined by evaluating the redeposition of added dyed canola oil onto a plastic substrate (polypropylene).

Preparation of the Dyed Canola Oil 250 mg of Solvent Red 26 (available from Sigma Aldrich) are added to 1 liter of Canola oil and mix well until the dye has fully dissolved PREPARATION: wash solutions are made in water of the target water hardness and pipetted into a dedicated small recipient. The wash solutions are pre-heated at target wash temperature and are kept at the set wash temperature during the wash cycle of the test procedure.

WASHING STEP: a clean polypropylene non-woven fabric is added to the wash solutions. 4 ml wash solution is used per $cm^2$ fabric. Per 4 ml wash solution, 0.125 ml dyed canola oil is added. Washing is done by pipetting the wash solution in and out of the recipient for 30 minutes. After 30 minutes of washing the wash solution is pipetted out.

RINSING STEP: demineralized water at ambient temperature is pipetted in and out 3 times of the recipient. The amount of demineralized water used is also 4 ml per $cm^2$ fabric. This process is repeated 4 times.

DRYING STEP: the polypropylene non-woven fabrics are removed from the recipients and are put to dry in an oven at 30° C. for 24 hours.

ANALYSIS: after drying, the polypropylene non-woven fabrics are subjected to image analysis and their color is compared to the color of non-soiled fabrics. A delta E value is obtained. A higher delta E value means more dyed canola oil has redeposited, meaning lower grease suspension capacity.

$$\Delta E=\sqrt{(\Delta L)^2+(\Delta a)^2+(\Delta b)^2}$$

A high delta E means that the fabric contains more dyed soil and is thus poorer at preventing the grease from depositing on the fabric substrate.

Example 1

| | Powder Composition 1 | Liquid Composition |
|---|---|---|
| Formula A (comparative) | 11.55 g | 2.16 g liquid composition 1 |
| Formula B | 11.55 g | 2.16 g liquid composition 2 |

| | Example 1 delta E Temperature | | |
|---|---|---|---|
| | 35° C. | 40° C. | 45° C. |
| Formula A (comparative) | 13.80 | 12.96 | 16.75 |
| Formula B | 10.36 | 9.82 | 12.56 |

As can be seen from the table above, Formula B according to this invention deliver a lower delta E and better grease suspension compared to Formula A not according to this invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An automatic dishwashing composition consisting of a ternary mixture of non-ionic surfactants consisting of:

(a) a non-ionic surfactant having a high cloud point of about 50° C. or above, wherein the high cloud point non-ionic surfactant is an alkoxylated $C_{6-22}$ alcohol non-ionic surfactant having a single alkoxylate and having from about 3 to about 20 moles of alkylene oxide per mole of surfactant;

(b) a non-ionic surfactant having a low cloud point below about 50° C., wherein the low cloud point non-ionic surfactant is an alkoxylated $C_{4-25}$ alcohol non-ionic surfactant having only two alkoxylate selected from ethoxy, propoxy and butoxy; and (c) an ethylene oxide—propylene oxide block copolymer having a cloud point below about 50° C., wherein the ethylene oxide—propylene oxide block copolymer is a triblock copolymer having one of the following structures:

$$EOx1POy1EOx2 \quad (I)$$

$$POy2EOx3POy3 \quad (II)$$

wherein each of x1, x2 and x3 is in the range of from about 1 to about 50 and each of y1, y2 and y3 is in the range of from about 10 to about 70, wherein the weight ratio of the high cloud point non-ionic surfactant (a) to the ethylene oxide—propylene oxide block copolymer (c) is at least about 1.2:1, and wherein the weight ratio of the low cloud point non-ionic surfactant (b) to the ethylene oxide—propylene oxide block copolymer (c) is at least about 1.2:1, wherein the composition optionally contains water and enzymes.

2. A composition according to claim 1 wherein the weight average ratio of the high cloud point to the low cloud point non-ionic surfactant is from about 2:1 to about 1:2.

3. A composition according to claim 1, wherein the cloud point of the high cloud point non-ionic surfactant is in the range of from about 60° C. to about 80° C. and wherein the cloud point of the low cloud point non-ionic surfactant is in the range of from about 8° C. to about 35° C.

4. A composition according to claim 1, wherein the high cloud point non-ionic surfactant is an ethoxylated $C_{6-22}$ alcohol non-ionic surfactant.

5. A composition according to claim 1, wherein the composition comprises from about 0.5 to about 40% by weight of the composition of the ternary mixture of non-ionic surfactants.

6. A composition according to claim 1, wherein the composition contains enzymes.

7. A composition according to claim 1, wherein the composition is a rinse aid.

8. A method of providing drying through the wash in a dishwasher comprising the step of delivering into the main wash of the dishwasher an automatic dishwashing detergent composition according to claim 1.

9. A method according to claim 8, wherein the detergent composition is in unit dose form.

10. A method of providing drying in a dishwasher comprising the step of delivering into the rinse of the dishwasher a rinse composition according to claim 1.

* * * * *